US008157965B2

(12) United States Patent
Saito

(10) Patent No.: US 8,157,965 B2
(45) Date of Patent: Apr. 17, 2012

(54) SHEET FORMING MACHINE

(75) Inventor: Tsutomu Saito, Tokyo (JP)

(73) Assignee: BS Co., Ltd., Tokyo (JP)

( * ) Notice: Subject to any disclaimer, the term of this patent is extended or adjusted under 35 U.S.C. 154(b) by 0 days.

(21) Appl. No.: 12/734,881

(22) PCT Filed: Nov. 26, 2008

(86) PCT No.: PCT/JP2008/071363

§ 371 (c)(1),
(2), (4) Date: May 28, 2010

(87) PCT Pub. No.: WO2009/072419

PCT Pub. Date: Jun. 11, 2009

(65) Prior Publication Data

US 2010/0300637 A1 Dec. 2, 2010

(30) Foreign Application Priority Data

Dec. 3, 2007 (JP) ..... 2007-312076

(51) Int. Cl.
*D21H 23/24* (2006.01)
*D21F 1/00* (2006.01)
*D21F 7/06* (2006.01)

(52) U.S. Cl. ..... 162/263; 162/312; 162/314; 162/343; 162/350; 162/265

(58) Field of Classification Search ..... 162/100, 162/109, 134, 135, 208, 212, 225, 265, 267, 162/268, 289, 290, 291, 298, 299, 300, 301, 162/308, 311, 312, 314, 327, 343, 345, 350, 162/263, 119, 154, 198, 252, 259, 262
See application file for complete search history.

(56) References Cited

U.S. PATENT DOCUMENTS 1,754,370 A * 4/1930 Raynes ..... 162/298
(Continued)

FOREIGN PATENT DOCUMENTS

DE 1955574 A1 5/1971
(Continued)

OTHER PUBLICATIONS

International Search Report dated Feb. 3, 2009, issued on PCT/JP2008/071363.

(Continued)

*Primary Examiner* — Eric Hug
*Assistant Examiner* — Peter Chin
(74) *Attorney, Agent, or Firm* — Edwards Wildman Palmer LLP

(57) ABSTRACT

[Problem] It provides a sheet forming machine which can make the thickness in the width direction of a sheet forming body be uniform, and also can obtain a sheet forming body which is integrated in stripe shapes by using different raw materials or raw materials of different colors in the width direction of one sheet forming body.

[Solution Means] A sheet forming machine for making a sheet forming body by dehydrating a raw material slurry supplied from a raw material supply tank while transporting the raw material slurry by a sheet forming belt, characterized in that the sheet forming belt has a sheet forming zone with ascending inclination, which is configured to be able to transport the raw material slurry while storing the raw material slurry, partition plates each having a shape extending in the transport direction of the raw material from a beginning end of the sheet forming zone are provided above the sheet forming belt at the sheet forming zone so as to partition the sheet forming zone in the width direction, and the length in the extending direction of the partition plate is equal to or greater than ⅙ of the width of the sheet forming belt.

5 Claims, 5 Drawing Sheets

U.S. PATENT DOCUMENTS

| | | | | |
|---|---|---|---|---|
| 2,241,500 | A * | 5/1941 | Batcheller | 162/119 |
| 3,190,790 | A * | 6/1965 | Ploetz et al. | 162/212 |
| 3,673,865 | A * | 7/1972 | Michaelsen | 73/159 |
| 3,785,922 | A * | 1/1974 | Keller | 162/299 |
| 3,907,635 | A | 9/1975 | Bringman | |
| 2007/0267163 | A1 | 11/2007 | Tamai et al. | |

FOREIGN PATENT DOCUMENTS

| | | | |
|---|---|---|---|
| DE | 19531475 | A1 | 2/1997 |
| EP | 0825011 | A1 | 2/1998 |
| GB | 1326080 | A | 8/1973 |
| JP | 08-224792 | A | 9/1996 |
| JP | 2007-308837 | A | 11/2007 |

OTHER PUBLICATIONS

Supplementary European Search Report dated Apr. 21, 2011, issued for the corresponding European patent application No. 08857515.4.

* cited by examiner

SHEET FORMING MACHINE

TECHNICAL FIELD

The present invention relates to a sheet forming machine for making a plate-shaped sheet forming body such as a fiberboard from raw material slurry.

BACKGROUND ART

Among previous sheet forming machines, there is a sheet forming machine disclosed in, for example, Patent Document 1. The sheet forming machine of the patent document is constituted to obtain a sheet forming body of a predetermined shape through obtaining a wet sheet form by sucking in moisture by suction box 4 provided below sheet forming belt 3 while transporting a raw material slurry made of a mixture of cement, pulp, or the like discharged from discharge opening 2 of raw material supply tank 1 by sheet forming belt 3, and cutting the sheet form with cutter 5, as shown in FIG. 1. Sheet forming belt 3 is usually constituted by felt or the like and mounted in a loop form between breast roll 6, which is provided to locate below discharge opening 2 of raw material supply tank 1, and bottom couch roll 7 which is provided to be spaced by a predetermined distance from the breast roll. Then, sheet forming belt 3 is inclined upward from the near side of a portion below discharge opening 2 toward bottom couch roll 7 side such that the discharged raw material slurry stays in the vicinity of a portion below discharge opening 2 and a sheet form can be made in order from the lower face of the sheet forming body. At inclined portion 8, although it is not shown, side plates are disposed in an upright fashion at both sides of sheet forming belt 3.

In each sheet forming body manufactured by the sheet forming machine, there is a problem that variations in the thickness in the width direction thereof occur due to the state of concentration, fiber length, grain size, or the like of the raw material, pollution of a felt, rapid spread in the width direction of the raw material which is supplied to inclined portion 8, or slowing of the speed of flow of the raw material in the vicinity of side plates of inclined portion 8. Also, since the raw material moves in the width direction of sheet forming belt 3 at inclined portion 8, so that only one raw material can be selected as the raw material of the sheet forming body, there is a problem that it is not possible to obtain a sheet forming body which is integrated in longitudinal stripe shapes by using different raw materials or raw materials of different colors in the width direction of sheet forming belt 3.

Patent Document 1: JP-UM-B-52-31325

DISCLOSURE OF INVENTION

Technical Problem

Therefore, the present invention has an object to provide a sheet forming machine which can make the thickness in the width direction of a sheet forming body be uniform, and also can obtain a sheet forming body integrated in longitudinal stripe shapes by using different raw materials or raw materials of different colors in the width direction of the sheet forming body.

Solution to Problem

In order to solve the above-mentioned problems, the inventors have closely studied, and consequently, found a solution means as described below, on the basis of the knowledge that a raw material slurry supplied onto a sheet forming belt is made into a sheet form in order from the sheet forming belt side, thereby becoming stable, but, the raw material of an upper layer portion freely moves in the width direction of the sheet forming belt, so that the thickness of the sheet is not made uniform, and furthermore, the raw materials are mixed to each other in the width direction of the sheet forming body, so that it is not possible to obtain a sheet forming body which is integrated in longitudinal stripe shapes by using different raw materials or raw materials of different colors.

That is, a sheet forming machine of the present invention is, as defined in claim 1, a sheet forming machine for making a sheet forming body by dehydrating raw material slurry supplied from a raw material supply tank while transporting the raw material slurry by a sheet forming belt, and characterized in that the sheet forming belt has a sheet forming zone with ascending inclination, which is configured to be able to transport the raw material slurry while storing the raw material slurry, partition plates each having a shape extending in the transport direction of the raw material from a beginning end of the sheet forming zone are provided above the sheet forming belt at the sheet forming zone so as to partition the sheet forming zone in the width direction, and the length in the extending direction of the partition plate is equal to or greater than ⅙ of the width of the sheet forming belt.

The invention defined in claim 2 is characterized in that in the sheet forming machine defined in claim 1, a roller capable of rotating in the transport direction is provided as a part of the partition plate.

The invention defined in claim 3 is characterized in that in the sheet forming machine defined in claim 2, the roller is provided in a plurality of numbers in the transport direction, and a partition belt is suspended from the rollers above the sheet forming belt, so that the sheet forming zone is partitioned in the width direction by the partition belt.

The invention defined in claim 4 is characterized in that in the sheet forming machine defined in claim 1, on the opposite side to the raw material supply tank of the sheet forming belt, there are provided a take-up means for taking up the sheet forming body, a cutting means for cutting at predetermined intervals the sheet forming body taken up by the take-up roll, and a thickness measuring means for measuring the thickness in the width direction of the sheet forming body; and an adjusting means for adjusting the flow of the raw material which is supplied into between the respective partition plates is provided between the raw material supply tank and the sheet forming zone, so that the flow of the raw material which is supplied into between the respective partition plates can be adjusted in accordance with the thickness of the sheet forming body measured by the thickness measuring means.

Also, the invention defined in claim 5 is characterized in that in the sheet forming machine defined in claim 4, a coating means for applying at least one ingredient of the ingredients of the raw material to between the sheet forming bodies which are taken up is provided at the take-up means.

Advantageous Effects of the Invention

According to the present invention; since a plurality of partition plates is provided in the width direction of the sheet forming belt above the sheet forming belt so as to be spaced from the sheet forming body, among the raw material slurry supplied from the raw material supply tank, the raw material slurry adjacent to the sheet forming belt is rapidly dehydrated between the respective partition plates without moving in the width direction on the sheet forming belt, thereby being transported while being made into a sheet form, and the raw material slurry distant from the sheet forming belt settles down, and is then dehydrated while nearing the sheet forming belt, thereby being transported. Therefore, homogenization of the density or the like of the raw material slurry in the vicinity of the sheet forming belt can be achieved. Also, it is possible to supply raw material slurries of different colors or materials between the partition plates, and a sheet forming body integrated in longitudinal stripe shapes which are different in color or material in the width direction of the sheet forming body can be obtained.

DESCRIPTION OF REFERENCE NUMERALS AND SIGNS

Figure 1:
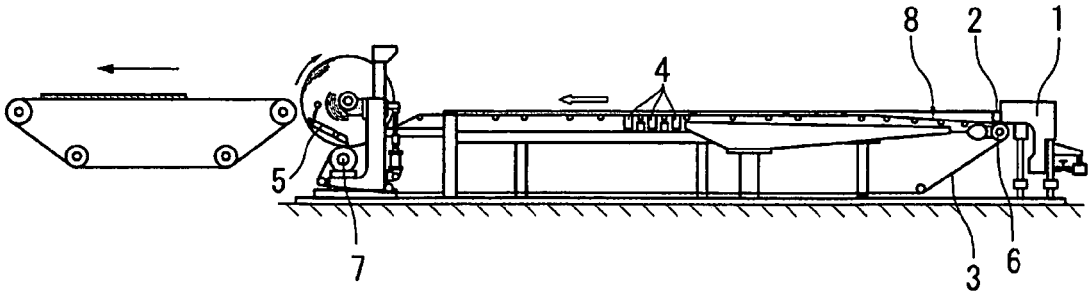
FIG. 1 is an explanatory view of a sheet forming machine in the past.

1 raw material supply tank
2 discharge opening
3 sheet forming belt
4 suction box
5 cutter
6 breast roll
7 bottom couch roll
8 inclined portion
10 agitator
11 raw material supply tank
12 discharge opening
13 sheet forming belt
16 breast roll
17 bottom couch roll
18 sheet forming zone
19 suction box
20 partition plate
21 plate-like body
22 gate
23 sheet forming body
24 take-up means (take-up roll)
25 cutting means (cutter)
26 thickness measuring means (measuring instrument)
27 rotating roll
28 partition belt
29 side plate
30 partition wall
31 feed opening
32 roll coater

BEST MODE FOR CARRYING OUT THE INVENTION

Next, a sheet forming machine of the present invention is explained using FIGS. 2 to 5B.

Figure 2:
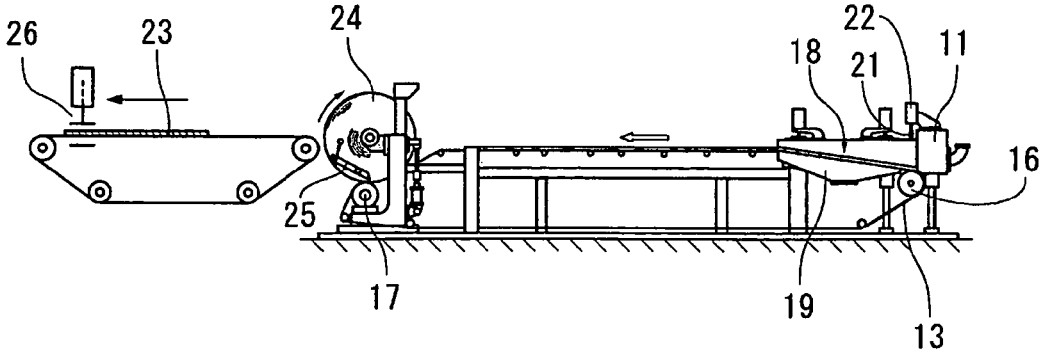
FIG. 2 is an explanatory view of the whole of a sheet forming machine of one embodiment of the present invention.
Figure 3:
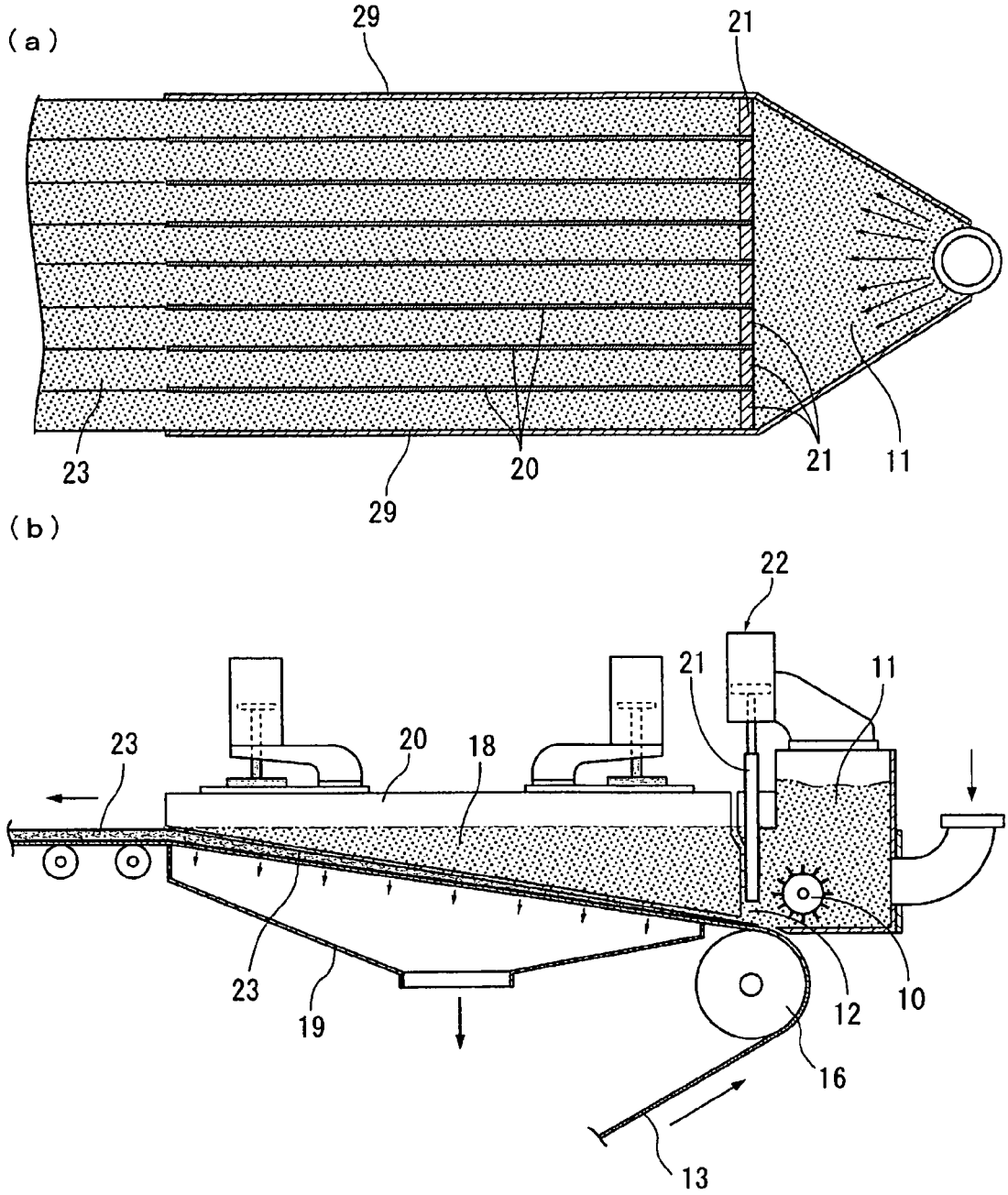
FIGS. 3A and 3B are enlarged explanatory views for explaining a portion of the sheet forming machine of the embodiment.
Figure 4:
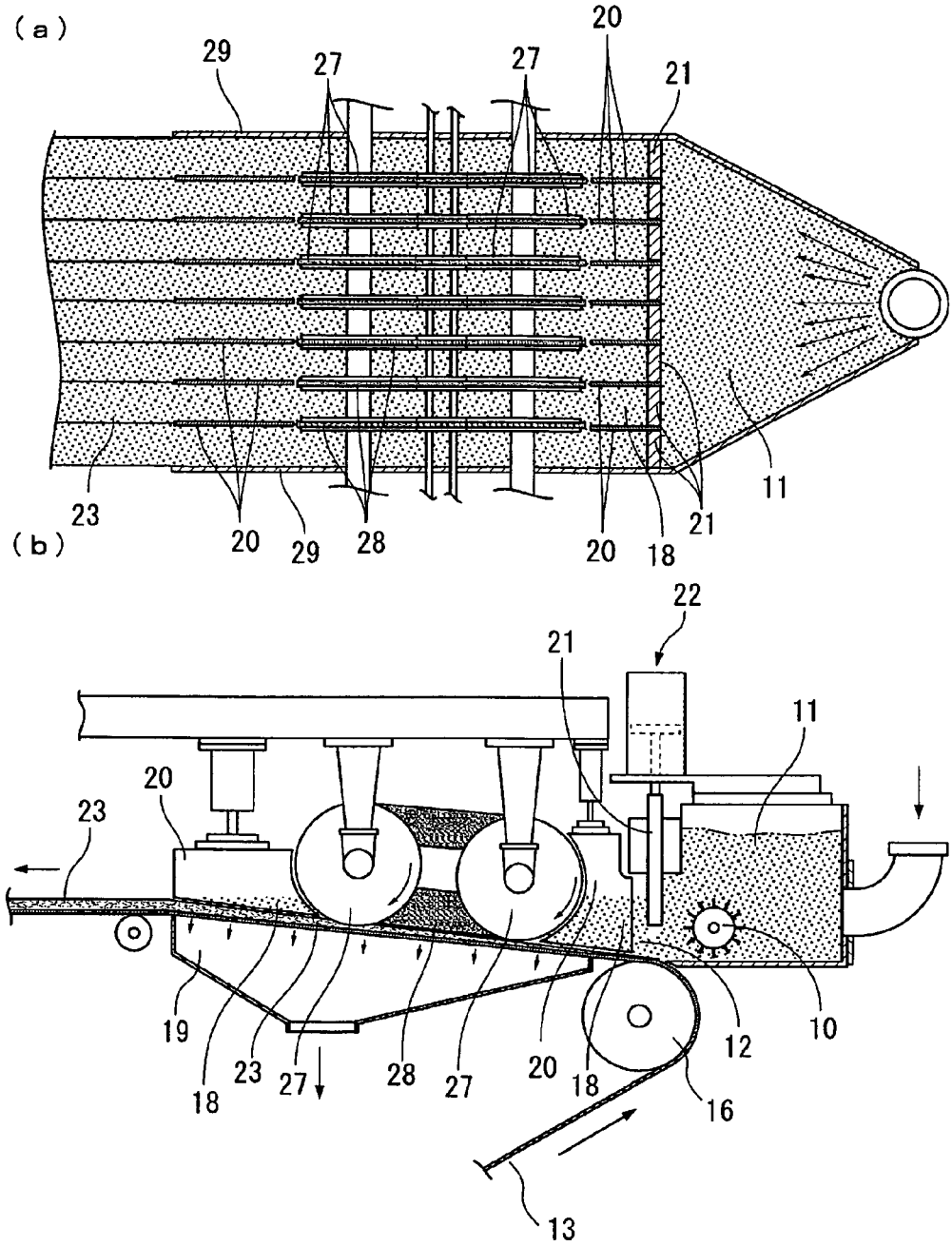
FIGS. 4A and 4B are explanatory views of a sheet forming machine of another embodiment of the present invention.
Figure 5:
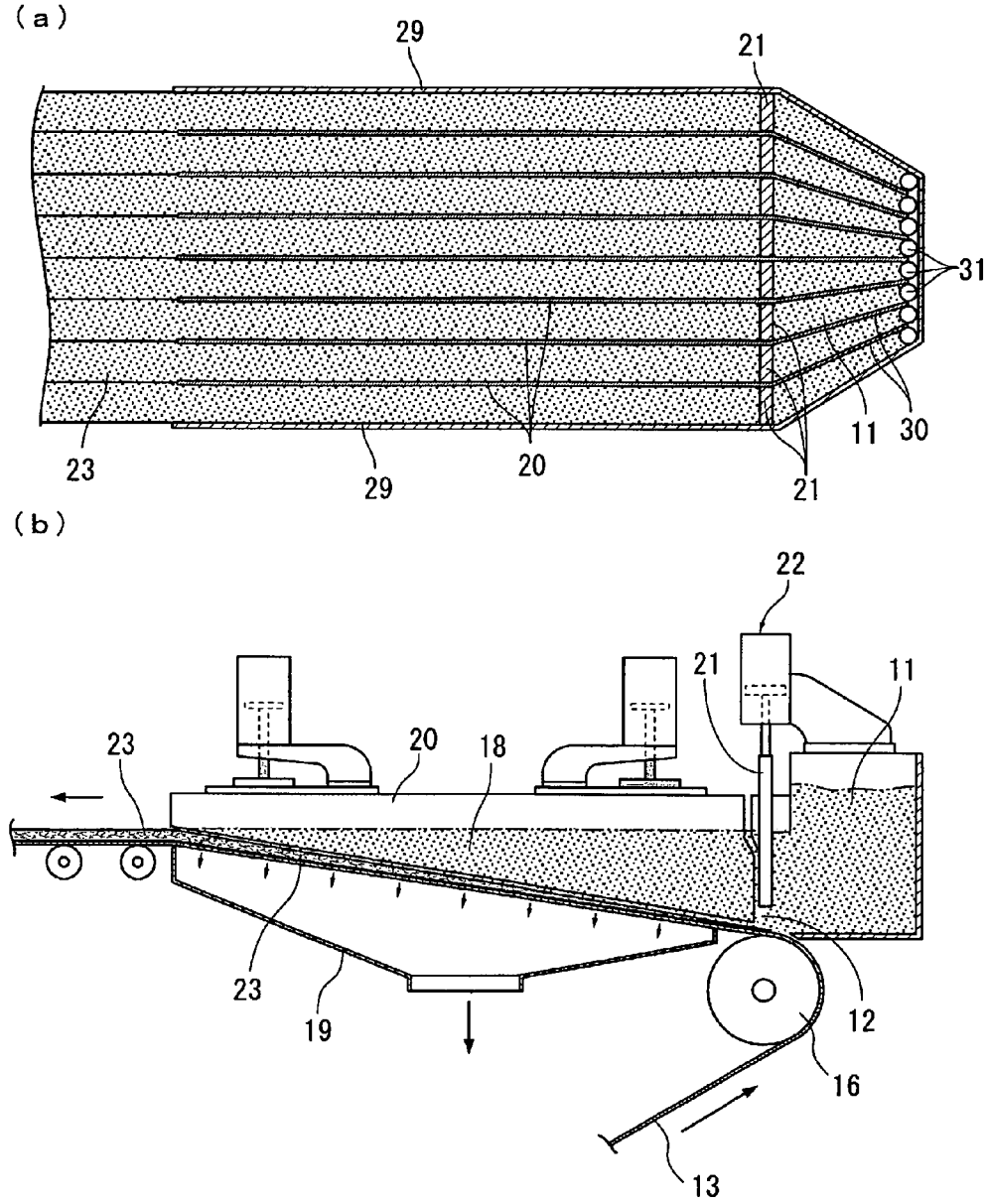
FIGS. 5A and 5B are explanatory views of a sheet forming machine of further another embodiment of the present invention.

As shown in FIGS. 2 to 3B, the sheet forming machine includes raw material supply tank 11 which has agitator 10 at the inside thereof and is for feeding a raw material slurry, and raw material supply tank 11 supplies the raw material onto sheet forming belt 13 through discharge opening 12. Sheet forming belt 13 is mounted in a loop form between breast roll 16, which is provided to locate below discharge opening 12 of raw material supply tank 11, and bottom couch roll 17 which is provided to be spaced by a predetermined distance from the breast roll. Then, sheet forming belt 13 has sheet forming zone 18 which is upwardly inclined (ascending-inclined) from the near side of a portion below discharge opening 12 toward bottom couch roll 17 side so as to be able to transport the discharged raw material slurry while storing the raw material. Side plates 29 are provided on both sides of sheet forming zone 18. Also, suction box 19 which is provided with a vacuum suction device and the like is provided on the opposite side to the raw material side of sheet forming zone 18 so as to be able to suck in moisture through sheet forming belt 13.

Partition plate 20 which is formed to extend in a direction facing from discharge opening 12 side, which is the beginning end of the sheet forming zone, toward bottom couch roll 17 is provided at sheet forming zone 18, and as shown in FIG. 3A, partition plate 20 is provided in a plurality of numbers in the width direction of sheet forming belt 13. The length in the extending direction of the partition plate is set to be equal to or greater than ⅙, preferably, equal to or greater than ¼, of the width of sheet forming belt 13. Also, in this embodiment, as shown in FIG. 3B, partition plate 20 is made into an approximately trapezoidal shape and has a uniform thickness. Discharge opening 12 side of the partition plate is set as an upper base side, and bottom couch roll 17 side thereof is set as a lower base side. Also, partition plate 20 is mounted so as to enter from the upper side of sheet forming belt 13 into the raw material slurry, and the lower face thereof is spaced from sheet forming belt 13. Also, if the sheet forming raw material is made into a sheet, so that the thickness thereof is increased, the raw material made into a sheet is injured by partition plates 20. Therefore, it is preferable to gradually increase the distance between the bottom face of partition plate 20 and sheet forming belt 13 from the vicinity of discharge opening 12 to a terminal of sheet forming zone 18.

By the above-described configuration, in the sheet forming machine of this embodiment, among the raw material slurry supplied from raw material supply tank 11, the raw material slurry adjacent to sheet forming belt 13 is rapidly dehydrated between respective partition plates 20, thereby being transported from each discharge opening 12 without moving in the width direction on sheet forming belt 13, and the raw material slurry distant from sheet forming belt 13 settles down after progress to bottom couch roll 17 side and is dehydrated getting near to sheet forming belt 13, thereby being made into a sheet form and transported. Therefore, homogenization of the raw material in the vicinity of sheet forming belt 13 can be achieved.

Also, on the opposite side to raw material supply tank 11 of sheet forming belt 13, a take-up roll is provided as take-up means 24 for taking up sheet forming body 23, and sheet forming body 23 taken up by take-up roll 24 is cut into a predetermined shape by cutting means 25 such as a cutter.

In the shown example, measuring instrument 26 which is a thickness measuring means capable of measuring the thickness of each portion in the width direction of sheet forming body 23 is provided on the downstream side of take-up roll 24, and also a flow adjuster is provided as flow adjusting means 22 so as to be able to regulate the amount of supply of the raw material from raw material supply tank 11 to sheet forming zone 18 by moving upward or downward, for example, plate-like body 21 between respective partition plates 20 at a portion where discharge opening 12 and sheet forming zone 18 are communicated with each other. By this, it is possible to measure the thickness of obtained sheet forming body 23 by measuring instrument 26 and adjust the amount of the raw material, which is supplied into between respective partition plates 20, by adjusting flow adjuster 22 on the basis of the measurement information. As a result, it is possible to perform fine adjustment on the basis of the thickness of obtained sheet forming body 23. Also, although the details will be explained using FIGS. 5A and 5B, in a case where different kinds of raw materials or raw materials of different colors are supplied from respective flow adjusters 22 into between respective partition plates 20, it also is possible to finely adjust concentration or the like of the raw materials, which are supplied into between respective partition plates 20, on the basis of the thickness of obtained sheet forming body 23.

Figure 6:
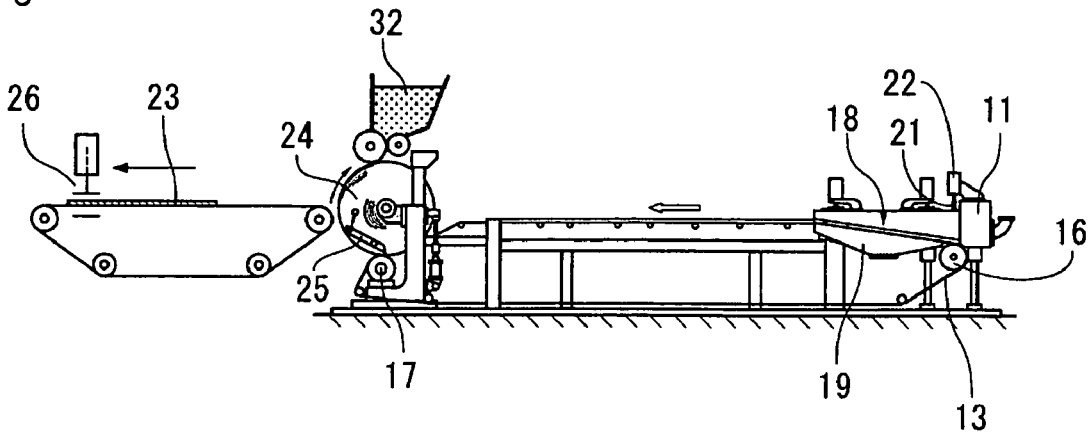
FIG. 6 is an explanatory view of a sheet forming machine of still further another embodiment of the present invention.

Also, if coating means such as a roll coater denoted by reference numeral 32 in FIG. 6 is provided in order to apply at least one ingredient of the ingredients of the raw material of the sheet forming body to between the taken-up sheet forming bodies at take-up roll 24, interlayer peeling of the sheet forming bodies can be prevented. With regard to a raw material which is applied, it is preferable if the material is at least one ingredient of the ingredients of the raw material slurry supplied from the raw material supply tank, and specifically, fly ash having a raw material grain size of 10 μm or less, or cement or the like having a grain size of 40 μm or less can be used.

Next, another embodiment of the present invention will be explained using FIGS. 4A and 4B. Also, in FIGS. 4A and 4B, with respect to the components having the same reference numerals as those of FIGS. 2 to 3B, explanation is omitted.

In the sheet forming machine shown in these drawings, partition plates 20 are provided at intervals in the extending direction thereof, rotating rollers 27 are suspended from the upper side of sheet forming belt 13, and partition belt 28 is mounted on rotating rollers 27. Partition belt 28 is for regulating the movement of the raw material slurry in the width direction of sheet forming belt 13, similarly to partition plate 20, is mounted in the slurry above sheet forming belt 13, and rotates in the transport direction of sheet forming belt 13 at approximately the same speed as sheet forming belt 13 in a state where it faces sheet forming belt 13. By this, slowing of the transport speed of the raw material slurry due to resistance of each partition plate 20 and abrasion of partition plate 20 can be prevented, and homogenization of the material can be achieved. Also, in the shown example, partition belt 28 is used, however, only rotating roller 27 may also be provided.

Next, further another embodiment of the present invention will be explained using FIGS. 5A and 5B. Also, in FIGS. 5A and 5B, with respect to the components having the same reference numerals as those of FIGS. 2 to 3B, explanation is omitted.

The sheet forming machine shown in these drawings is for obtaining sheet forming body 23 integrated in longitudinal stripe shapes by using the raw materials of different kinds or colors in the width direction of sheet forming body 23.

As shown in the drawings, the raw material supply tank 11 is partitioned by partition walls 30 so as to be able to supply different raw materials into spaces partitioned by partition plates 20 of sheet forming zone 18, and feed opening 31 for feeding the raw material into each partitioned region is provided.

By the above-described configuration, a uniform thickness can be realized only by feeding the raw materials of different materials or colors from respective feed openings 31, and furthermore, the obtained sheet forming body 23 can have different materials or colors in the width direction thereof.

As described above, in the present invention, sheet forming zone 18 means a zone which transports the raw material slurry on sheet forming belt 13 and has an ascending inclination, and although it is not to be particularly limited, the angle of inclination thereof may be in the range of, for example, 5° to 30°.

Also, in the present invention, partition plate 20 is made such that with a position where sheet forming zone 18 and discharge opening 12 come into contact with each other as a beginning end, the length thereof is equal to or greater than ⅙ of the length in the width direction of sheet forming belt 13 so as to become a range in which the raw material slurry does not move in the width direction of sheet forming belt 13. Further, preferably, the length is equal to or greater than ¼, and more preferably, the length is set to be almost the same extent as the length of sheet forming zone 18.

Also, as a material constituting partition plate 20, for example, synthetic resin or the like can be used. However, in particular, it is preferable to use a material having low resistance to the raw material slurry. Also, although it is not to be particularly limited, the thickness of partition plate 20 may be set to be in the range of, for example, 0.5 mm to 3 mm. Also with respect to the planar shape of partition plate 20, provided that the partition plate can partition the sheet forming zone in a state where it is spaced from sheet forming belt 13 of sheet forming zone 18, it is not to be particularly limited. Also, since partition plate 20 is often dirtied with repetition of the sheet forming, it is preferable to regularly take it out and clean it.

Also, the material of sheet forming belt 13 is not particularly limited, provided that it has water permeability allowing the raw material slurry to be dehydrated and strength capable of transporting the raw material slurry. For example, a felt or the like may be used. Also with respect to the width of sheet forming belt 13, although it is not to be particularly limited, the width may be set to be in the range of, for example, 1000 mm to 10000 mm. Also with respect to the thickness of the sheet forming belt, although it is not to be particularly limited, the thickness may be set to be in the range of, for example, 0.5 mm to 10 mm. Also with respect to the rotation speed of the sheet forming belt, although it depends on the raw material, the rotation speed may be set to be in the range of, for example, 5 m/min. to 150 m/min.

Also, with respect to the raw material which can be used in the sheet forming machine of the present invention, although it is not to be particularly limited, for example, mainly, a mixture of a mineral material such as cement of 90% by weight to 95% by weight and a fiber material such as pulp of 5% by weight to 10% by weight may be used. Also, the raw material is adjusted and used such that solid content concentration thereof is 5% by weight to 30% by weight in the raw material supply tank 11.

Industrial Applicability

The sheet forming machine of the present invention can be extensively used for sheet forming bodies which use raw material slurries.

The invention claimed is:

1. A sheet forming machine for making a sheet forming body by dehydrating raw material slurry supplied from a raw material supply tank while transporting the raw material slurry by a sheet forming belt, the sheet forming machine comprising:

the sheet forming belt having a sheet forming zone with ascending inclination, the sheet forming zone including a suction box, side plates, and a partition plate, the sheet forming zone allowing raw slurry material on the sheet forming belt corresponding to a pre-fully formed sheet forming body, to be transported along the forming belt while also storing an amount of the raw material slurry above the pre-fully formed sheet forming body; wherein, the partition plate is provided above the sheet forming belt at the sheet forming zone so as to partition the sheet forming zone in the width direction thereof, the partition plate extending in the transport direction of the raw material from a beginning end to the sheet forming zone to a terminal end of the sheet forming zone; wherein a distance between a bottom face of the partition plate and the sheet forming belt is gradually increased from the beginning end of the sheet forming zone to the terming end of the sheet forming zone.

2. The sheet forming machine of claim 1, wherein as a part of the partition plate, a roller is provided which can rotate in the transport direction.

3. The sheet forming machine of claim 2, wherein a partition belt is suspended from the roller and is disposed above the sheet forming belt so that the sheet forming zone is partitioned in the width direction by the partition belt.

4. The sheet forming machine of claim 1, wherein on a side of the sheet forming belt that is opposite to the raw material supply tank a take-up means for taking up the sheet forming body, a cutting means for cutting at predetermined intervals the sheet forming body taken up by the take-up roll, and a thickness measuring means for measuring the thickness in the width direction of the sheet forming body are provided, and an adjusting means for adjusting the flow of the raw material which is supplied between the respective partition plates is provided between the raw material supply tank and the sheet forming zone so that the flow of the raw material which is supplied into between the respective partition plates can be adjusted in accordance with the thickness of the sheet forming body measured by the thickness measuring means.

5. The sheet forming machine of claim 4, wherein a coating means for applying at least one ingredient of the ingredients of the raw material to between the sheet forming bodies which are taken up is provided at the take-up means.

* * * * *